US010299605B2

(12) United States Patent
Choi

(10) Patent No.: US 10,299,605 B2
(45) Date of Patent: May 28, 2019

(54) SOFA CHAIR

(71) Applicant: Anyplace Concepts Co., Ltd., Xiamen (CN)

(72) Inventor: Kwan Jun Choi, Xiamen (CN)

(73) Assignee: Anyplace Concepts Co., LTD., Xiamen (CN)

( * ) Notice: Subject to any disclaimer, the term of this patent is extended or adjusted under 35 U.S.C. 154(b) by 0 days.

(21) Appl. No.: 15/295,548

(22) Filed: Oct. 17, 2016

(65) Prior Publication Data

US 2017/0105544 A1 Apr. 20, 2017

(30) Foreign Application Priority Data

Oct. 16, 2015 (CN) ..... 2015 2 0799327 U

(51) Int. Cl.

| | |
|---|---|
| ***A47C 4/02*** | (2006.01) |
| ***A47C 31/02*** | (2006.01) |
| ***A47C 31/11*** | (2006.01) |
| ***A47C 7/54*** | (2006.01) |
| ***A47C 17/02*** | (2006.01) |

(52) U.S. Cl.

CPC ..... *A47C 31/11* (2013.01); *A47C 4/028* (2013.01); *A47C 7/54* (2013.01); *A47C 17/02* (2013.01); *A47C 31/023* (2013.01)

(58) Field of Classification Search

CPC ..... A47C 4/02; A47C 4/028; A47C 31/023

See application file for complete search history.

(56) References Cited

U.S. PATENT DOCUMENTS

| | | | | | |
|---|---|---|---|---|---|
| 2,522,404 | A | * | 9/1950 | Siebelist | A47C 31/11 297/224 |
| 2,710,650 | A | * | 6/1955 | Sowder | B61B 12/002 104/115 |
| 3,185,179 | A | | 5/1965 | Harautuneian | |
| 3,387,341 | A | | 6/1968 | Mates | |
| 3,836,698 | A | | 9/1974 | Bawa | |
| 4,141,590 | A | * | 2/1979 | Lafer | A47B 13/06 297/440.1 |
| 4,421,356 | A | * | 12/1983 | Singer | A47C 3/00 248/165 |
| 4,810,008 | A | | 3/1989 | Brodie | |
| 5,316,349 | A | | 5/1994 | Rafeld | |
| 5,649,742 | A | * | 7/1997 | Liu | A47C 3/00 297/440.22 |
| 5,678,706 | A | | 10/1997 | Husak | |
| 5,678,890 | A | | 10/1997 | Tenbroeck | |

(Continued)

*Primary Examiner* — Timothy J Brindley

(74) *Attorney, Agent, or Firm* — Morgan, Lewis & Bockius LLP

(57) ABSTRACT

A sofa chair includes a support frame, a seat frame supported by the support frame, and a cover disposed on the seat frame or on the seat and support frames. The support frame includes front and rear H-shaped frames, each with left and right legs connected by a lateral bar. The seat frame includes left and right bars, and connecting pieces disposed at bottoms of front and rear portions of the left and right bars. The connecting pieces are coupled to corresponding upper portions of the legs. The rear H-shaped frame is taller than the front H-shaped frame such that the seat frame is tilted upwardly with the front portions of the left and right bars positioned lower than the rear portions of the left and right bars of the seat frame.

17 Claims, 3 Drawing Sheets

(56) References Cited

U.S. PATENT DOCUMENTS 5,806,830 A 9/1998 Alvarez
5,964,252 A 10/1999 Simmons
6,415,801 B1 7/2002 Gallegos
6,840,573 B1 * 1/2005 Yao ..... A47C 4/02 297/16.1
6,848,740 B1 * 2/2005 Reese ..... A47C 4/03 297/16.1
D504,271 S * 4/2005 Springer ..... D6/611
7,011,367 B2 * 3/2006 Riley ..... A47C 31/11 297/219.1
D553,894 S * 10/2007 Springer ..... D6/611
7,293,840 B1 11/2007 Schu
7,740,320 B2 * 6/2010 Chiang ..... A47C 4/02 297/440.15
8,038,211 B2 * 10/2011 Berk ..... A47C 31/11 297/229
8,870,290 B2 * 10/2014 Xu ..... A47C 4/02 297/440.18
D752,890 S * 4/2016 Akkad ..... D6/368
9,351,578 B2 * 5/2016 Homans ..... A47C 4/30
9,456,693 B1 * 10/2016 Broughton ..... A47B 47/0033
D781,607 S * 3/2017 Bittle ..... D6/368
9,648,960 B2 * 5/2017 Scales ..... A47C 31/11
9,782,006 B2 * 10/2017 Arruda ..... A47C 4/021
9,986,834 B1 6/2018 Chen
2003/0127852 A1 7/2003 Usui
2005/0202393 A1 9/2005 Morgan
2005/0274298 A1 * 12/2005 Paulin ..... A47B 13/083 108/90
2006/0033367 A1 * 2/2006 Sweeney ..... A47C 3/04 297/239
2006/0284460 A1 * 12/2006 Tseng ..... A47C 31/11 297/228.1
2007/0052268 A1 * 3/2007 Daniels ..... A47C 31/11 297/219.1
2008/0048438 A1 2/2008 Weise
2008/0179471 A1 7/2008 Verdelli
2012/0146371 A1 * 6/2012 Cotton ..... A47C 31/11 297/219.1
2012/0326475 A1 * 12/2012 Campbell ..... A47C 31/11 297/188.01
2014/0049091 A1 * 2/2014 Gross ..... A47C 7/22 297/452.63
2017/0105544 A1 4/2017 Choi

* cited by examiner

SOFA CHAIR

CROSS-REFERENCE TO RELATED APPLICATION

The present application claims priority of Chinese Patent Application No. 201520799327.X filed Oct. 16, 2015, the entire contents of which are incorporated herein for all purposes by this reference.

FIELD OF THE INVENTION

The present invention generally relates to a chair, and more particularly, to a sofa chair.

BACKGROUND

Chairs are a common furniture item. Some chairs are made of wood or bamboo. Such chairs are usually uncomfortable as their seats are stiff, and cold in the winter. Thus, in recent years, sofa chairs have become more and more popular.

However, some existing sofa chairs are made and pre-assembled in factories. Once out of the factories, they are usually fixed, and cannot be disassembled or re-assembled. As such, they are difficult to handle, require larger shipping and storage spaces, and increase transportation cost. Some other existing sofa chairs can be disassembled and re-assembled. These sofa chairs are usually complex, and inconvenient to assemble. In addition, the production cost and defect rate of these sofa chairs are relatively high.

Given the current state of the art, there remains a need for a sofa chair that addresses the abovementioned issues.

The information disclosed in this Background section is provided for an understanding of the general background of the invention and is not an acknowledgement or suggestion that this information forms part of the prior art already known to a person skilled in the art.

SUMMARY

Various embodiments of the present invention provide a sofa chair disclosed below.

In some embodiments, a sofa chair includes a support frame, a seat frame coupled to and supported by the support frame, and a cover disposed on the seat frame or on the seat and support frames. The support frame includes front and rear H-shaped frames, each including left and right legs connected by a lateral bar. The seat frame includes left and right bars, and connecting pieces disposed at bottoms of front and rear portions of the left and right bars. Each of the front and rear left legs includes an upper portion coupled with the connecting pieces disposed at the bottoms of the front and rear portions of the left bar, respectively. Each of the front and rear right legs includes an upper portion coupled with the connecting pieces disposed at the bottoms of the front and rear portions of the right bar, respectively. The rear H-shaped frame is taller than the front H-shaped frame such that the seat frame is tilted upwardly with the front portions of the left and right bars positioned lower than the rear portions of the left and right bars of the seat frame.

In an embodiment, one or each of the left and right bars of the seat frame is tubular. In an embodiment, each of the left and right bars is a tube bent downwardly and outwardly. In an embodiment, the left and right bars are disposed on left and right sides of the sofa chair, and symmetric to each other.

In an embodiment, each of the front left and right legs and the rear left and right legs is a bent tube.

In an embodiment, the upper portion of the front left leg, the front right leg, the rear left leg, or the rear right leg is inserted into the corresponding connecting piece disposed at the front portion of the left bar, the front portion of the right bar, the rear portion of the left bar, or the rear portion of the right bar. In an exemplary embodiment, the upper portion is contracted from its leg and the corresponding connecting piece has a diameter corresponding to the leg to receive the upper portion.

In another embodiment, the upper portions of the front left leg, the front right leg, the rear left leg, and the rear right leg are inserted into the corresponding connecting pieces disposed at the front portion of the left bar, the front portion of the right bar, the rear portion of the left bar, and the rear portion of the right bar, respectively.

In an exemplary embodiment, the upper portion of the front left leg, the front right leg, the rear left leg, or the rear right leg receives the corresponding connecting piece disposed at the front portion of the left bar, the front portion of the right bar, the rear portion of the left bar, or the rear portion of the right bar.

In various embodiments, the connecting piece disposed at the front portion of the left bar, the front portion of the right bar, the rear portion of the left bar, or the rear portion of the right bar is inserted into the corresponding upper portion of the front left leg, the front right leg, the rear left leg, or the rear right leg.

In an exemplary embodiment, the connecting pieces disposed at the front portion of the left bar, the front portion of the right bar, the rear portion of the left bar, and the rear portion of the right bar are inserted into the corresponding upper portions of the front left leg, the front right leg, the rear left leg, and the rear right leg, respectively.

In an embodiment, each of the front left and right legs and the rear left and right legs includes a lower portion bent outwardly.

In some embodiment, the support frame further includes elastic sheaths covering and protecting lower portions of the front left leg, the front right leg, the rear left leg, and the rear right leg.

In some embodiments, the cover includes a cushion and a cloth encasing the cushion. In an embodiment, the cloth includes one or more holders at each of the left and right sides of the sofa chair to allow insertion of the left and right bars of the seat frame, respectively.

The systems and methods of the present invention have other features and advantages that will be apparent from or are set forth in more detail in the accompanying drawings, which are incorporated herein, and the following Detailed Description, which together serve to explain certain principles of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Reference will now be made in detail to implementations of the present application as illustrated in the accompanying drawings. The same reference indicators will be used throughout the drawings and the following detailed description to refer to the same or like parts. Those of ordinary skill in the art will realize that the following detailed description of the present application is illustrative only and is not intended to be in any way limiting. Other embodiments of the present application will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of this disclosure can be made without departing from its spirit and scope, as will be apparent to those skilled in the art. The specific embodiments described herein are offered by way of example only, and the disclosure is to be limited only by the terms of the appended claims, along with the full scope of equivalents to which such claims are entitled.

Figure 1:
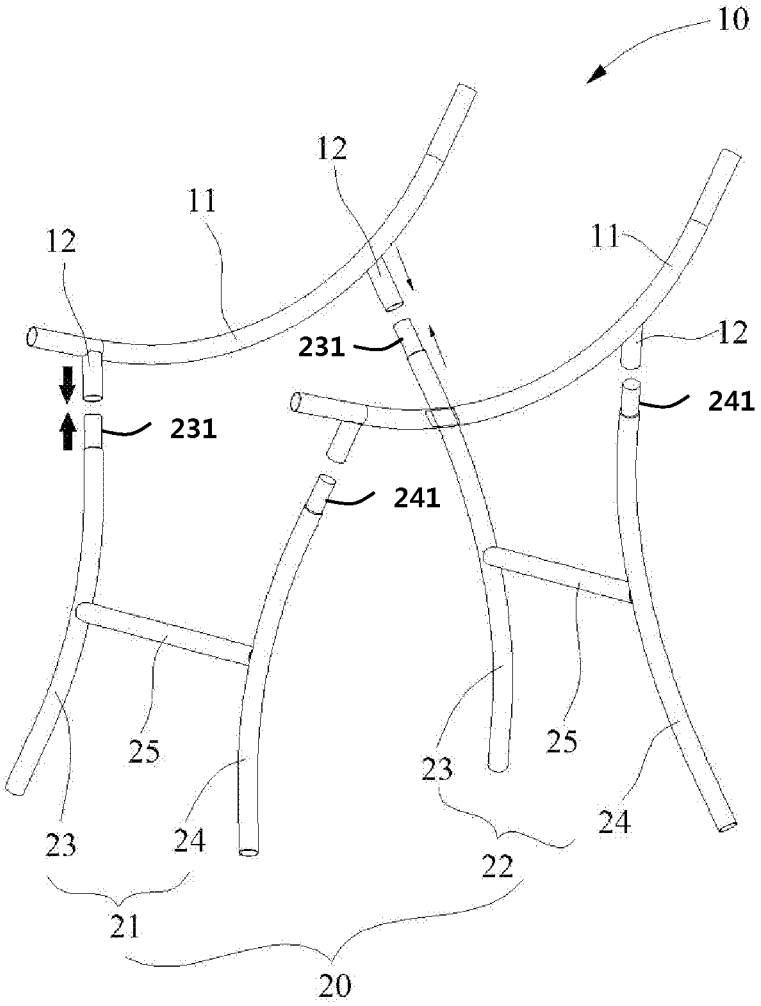
FIG. 1 is a schematic view illustrating the disassembled seat and support frames of a sofa chair in accordance with some embodiments of the present invention.
Figure 2:
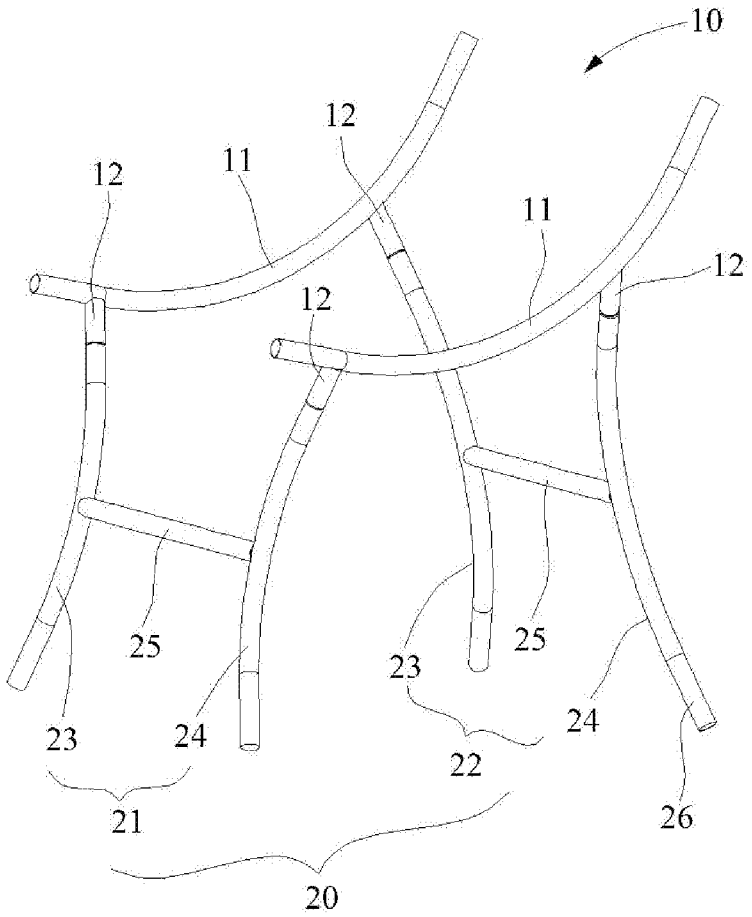
FIG. 2 is a schematic view illustrating the assembled seat and support frames of a sofa chair in accordance with some embodiments of the present invention.
Figure 3:
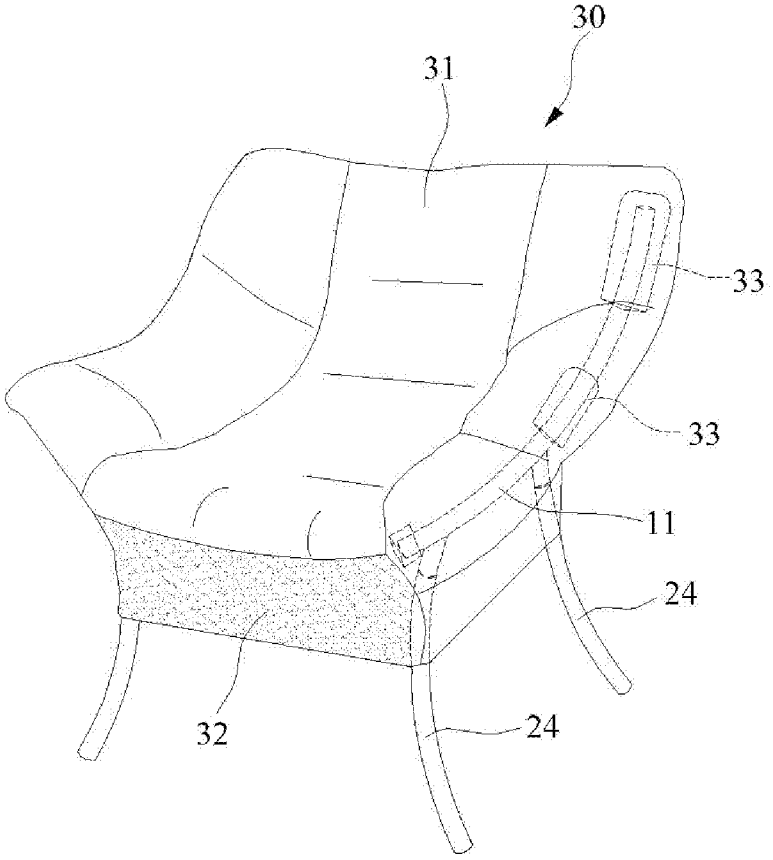
FIG. 3 is a schematic view illustrating a sofa chair in accordance with some embodiments of the present invention.

Referring to FIGS. 1-3, a sofa chair is depicted in accordance with some embodiments of the present invention. The sofa chair generally includes a seat frame such as seat frame 10, a support frame such as support frame 20, and a cover such as cover 30. When assembled, the seat frame is coupled to and supported by the support frame. Collectively, the seat frame and the support frame forms the chair frame of the sofa chair. The cover is disposed on the chair frame, for example, on the seat frame or on both the seat and support frames.

In some embodiments, seat frame 10 includes two bars such as left and right bars 11 and connecting pieces such as connecting pieces 12. Left and right bars 11 are disposed on left and right sides of the sofa chair, and preferably symmetric or substantially symmetric to each other. Connecting pieces 12 are disposed at bottoms of front and rear portions of the left and right bars, and are configured to couple with the support frame. In some embodiments, one or each of left and right bars 11 is made of a tube. The tube can be straight or bent (e.g., curved), and can be solid or hollow. By way of example, FIGS. 1-3 illustrate each of left and right bars 11, which are tubular and bent with a smooth bending curvature. In some embodiments, each of the left and right bars is a tube bent downwardly and outwardly.

In some embodiments, support frame 20 includes front and rear frames, each for example of an H-shape, such as front H-shaped frame 21 and rear H-shaped frame 22. Each of the H-shaped frame 21 and rear H-shaped frame 22 includes left leg 23, right leg 24 and lateral bar 25 connecting the left and right legs. In a preferred embodiment, rear H-shaped frame 22 is taller than front H-shaped frame 21 such that seat frame 10 is tilted upwardly with the front portions of left and right bars 11 positioned lower than the rear portions of the left and right bars of left and right bars 11. Like left and right bars 11, in some embodiments, left legs 23 and right legs 24 are bent tubes.

In some embodiments, each of front and rear left legs 23 includes an upper portion such as upper portion 231, and each of front and rear right legs 24 includes an upper portion such as upper portion 24. Upper portions 231 and connecting pieces 12 disposed at the bottoms of the front and rear portions of the left bar are configured to couple with each other. Upper portion 241 and connecting pieces 12 disposed at the bottoms of the front and rear portions of the right bar are configured to couple with each other.

In an embodiment, upper portions 231, 241 and connecting pieces 12 are configured such as each upper portion is inserted into a corresponding connecting piece. In an exemplary embodiment, one or each connecting piece (e.g., connecting piece disposed at the bottom of the front portion of the left bar) has a diameter corresponding to (e.g., the same as) the diameter of the leg (e.g., the left leg of the front H-shaped frame). The connecting piece is configured to have an opening or is made of a hollow tube. The upper portion of the leg (e.g., upper portion 231 of the left leg of the front H-shaped frame) is contracted from its leg and thus has a diameter smaller than the leg. The upper portion of the leg is inserted into the connecting piece, and coupled to the connecting piece for example by press-fit.

In an alternative embodiment, upper portions 231, 241 and connecting pieces 12 are configured such as each upper portion receives a corresponding connecting piece, or each connecting piece is inserted into a corresponding upper portion. For example, each of upper portions 231, 241 is configured to have an opening or made of a hollow tube. In another embodiment, upper portions 231, 241 and connecting pieces 12 are configured such as one upper portion is inserted into a corresponding connecting piece, and another upper portion receives a corresponding connecting piece.

In some embodiments, one or each of the front left and right legs and the rear left and right legs includes a lower portion bent outwardly, an example of which is illustrated in the figures.

In some embodiments, support frame 20 further includes protections to protect lower portions of the front left leg, the front right leg, the rear left leg, and/or the rear right leg. By way of illustration, FIG. 2 shows protections such as elastic (e.g., rubbery) sheaths 26 covering and protecting lower portions of the front left leg, the front right leg, the rear left leg, and the rear right leg.

In some embodiments, cover 30 includes a cushion such as cushion 32 and a cloth such as cloth 31 encasing the cushion. As used here, the term "encasing" does not necessarily mean the cushion is completely and fully covered by the cloth. In some embodiments, cloth 31 includes one or more holders such as holders 33 disposed or formed at each of left and right sides of the sofa chair. In some embodiments, holder 33 is shaped as a pocket, a sleeve, or the like. Holders 33 allow the insertion of the left and right bars of the seat frame, and thus secure cover 30 on the seat frame.

One way to assemble the sofa chair is as follows. First, dispose and secure cover 30 on seat frame 10, for example, by inserting left and right bars 11 of the seat frame into holders 33 of the cover. Then, couple seat frame 10 with support frame 20, for example, by placing upper portions 231, 241 of the legs of the front and rear frames under the cover and coupling upper portions 231, 241 with corresponding connecting pieces 12 of bars 11.

As disclosed herein, the chair frame of an exemplary embodiment of the present invention is formed by coupling the bars of the seat frame with the legs of the support frame, and the sofa chair is formed by disposing the cover on the chair frame. As such, the sofa chair of the present invention has several advantages over conventional sofa chairs. For example, the sofa chair of the present invention is relatively simple in structure and more compact when disassembled, resulting in low production cost and ease of handling and storing. In addition, the sofa chair of the present invention is robust and reliable as the left and right bars of the seat frame, the H-shaped front and rear frames, and/or the outwardly bent legs enhance the strength of the sofa chair.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. The terms "left" or "right", "front" or "rear", and etc. are used to describe features of the exemplary embodiments with reference to the positions of such features as displayed in the figures.

What is claimed is:

1. A sofa chair, comprising:

a support frame comprising front and rear H-shaped frames, each comprising left and right legs connected by a lateral bar;

a seat frame coupled to and supported by the support frame, the seat frame comprising left and right bars, and connecting pieces disposed at bottoms of front and rear portions of the left and right bars; and a cover comprising a cushion and a cloth encasing the cushion, wherein the cover comprises an upper section coupled with the seat frame, and a lower section below the upper section and covering a portion of the support frame;

wherein:

each of the front and rear left legs comprises an upper portion coupled with the connecting pieces disposed at the bottoms of the front and rear portions of the left bar, respectively, each of the front and rear right legs comprises an upper portion coupled with the connecting pieces disposed at the bottoms of the front and rear portions of the right bar, respectively, and the rear H-shaped frame is taller than the front H-shaped frame such that the seat frame is tilted upwardly with the front portions of the left and right bars positioned lower than the rear portions of the left and right bars of the seat frame.

2. The sofa chair of claim 1, wherein one or each of the left and right bars of the seat frame is tubular.

3. The sofa chair of claim 1, wherein each of the left and right bars is a tube bent downwardly and outwardly.

4. The sofa chair of claim 1, wherein the left and right bars are disposed on left and right sides of the sofa chair, and symmetric to each other.

5. The sofa chair of claim 1, wherein each of the front left and right legs and the rear left and right legs is a bent tube.

6. The sofa chair of claim 1, wherein the upper portion of the front left leg, the front right leg, the rear left leg, or the rear right leg is inserted into the corresponding connecting piece disposed at the front portion of the left bar, the front portion of the right bar, the rear portion of the left bar, or the rear portion of the right bar.

7. The sofa chair of claim 6, wherein the upper portion is contracted from its leg and the corresponding connecting piece has a diameter corresponding to the leg to receive the upper portion.

8. The sofa chair of claim 1, wherein the upper portions of the front left leg, the front right leg, the rear left leg, and the rear right leg are inserted into the corresponding connecting pieces disposed at the front portion of the left bar, the front portion of the right bar, the rear portion of the left bar, and the rear portion of the right bar, respectively.

9. The sofa chair of claim 1, wherein the upper portion of the front left leg, the front right leg, the rear left leg, or the rear right leg receives the corresponding connecting piece disposed at the front portion of the left bar, the front portion of the right bar, the rear portion of the left bar, or the rear portion of the right bar.

10. The sofa chair of claim 1, wherein the connecting piece disposed at the front portion of the left bar, the front portion of the right bar, the rear portion of the left bar, or the rear portion of the right bar is inserted into the corresponding upper portion of the front left leg, the front right leg, the rear left leg, or the rear right leg.

11. The sofa chair of claim 1, wherein the connecting pieces disposed at the front portion of the left bar, the front portion of the right bar, the rear portion of the left bar, and the rear portion of the right bar are inserted into the corresponding upper portions of the front left leg, the front right leg, the rear left leg, and the rear right leg, respectively.

12. The sofa chair of claim 1, wherein the support frame further comprises elastic sheaths covering and protecting lower portions of the front left leg, the front right leg, the rear left leg, and the rear right leg.

13. The sofa chair of claim 1, wherein the cover comprises a cushion and a cloth encasing the cushion.

14. The sofa chair of claim 1, wherein the upper section of the cover comprises one or more holders at each of left and right sides of the sofa chair to allow insertion of the left and right bars of the seat frame, respectively.

15. The sofa chair of claim 1, wherein the lower section of the cover drapes around a periphery of the support frame, and rests on the front and rear left legs and on the front and rear right legs.

16. The sofa chair of claim 1, wherein each of the front left and right legs and the rear left and right legs comprises a lower portion bent outwardly.

17. The sofa chair of claim 1, wherein each of the front left and right legs and the rear left and right legs comprises a lower portion that is exposed outside of the lower section of the cover and bent outwardly.

* * * * *